United States Patent [19]

Kirkland

[11] Patent Number: 4,554,681

[45] Date of Patent: Nov. 26, 1985

[54] REPLACEABLE SHOULDER PADDING FOR FOOTBALL AND THE LIKE

[75] Inventor: Alvin E. Kirkland, Playa Del Rey, Calif.

[73] Assignee: Conlin Bros., Inc., Whittier, Calif.

[21] Appl. No.: 619,574

[22] Filed: Jun. 11, 1984

[51] Int. Cl.[4] ..... A41D 13/00

[52] U.S. Cl. ..... 2/2

[58] Field of Search ..... 2/2, DIG. 6, 257, 263, 2/265, 20, 52; 24/306, 31 U; 52/DIG. 13; 428/100; 128/DIG. 15; 248/206.1, 231.91, 205.2

[56] References Cited

U.S. PATENT DOCUMENTS

| | | | |
|---|---|---|---|
| 1,709,184 | 2/1927 | Mullins | 2/2 |
| 1,970,130 | 8/1934 | Dickenson | 2/2 |
| 2,637,849 | 5/1953 | Nelson | 2/2 |
| 2,892,193 | 6/1959 | Sowle | 2/2 |
| 3,397,406 | 8/1968 | Leach | 2/52 |
| 4,030,689 | 6/1977 | Rodriguez | 24/306 |
| 4,135,252 | 1/1979 | Latina | 2/2 |
| 4,158,242 | 6/1979 | Mitchell | 2/2 |
| 4,295,227 | 10/1981 | Mitchell | 2/2 |
| 4,320,537 | 3/1982 | Mitchell | 2/2 |
| 4,322,859 | 4/1982 | Mitchell | 2/2 |

*Primary Examiner*—Louis K. Rimrodt
*Assistant Examiner*—Joseph S. Machuga
*Attorney, Agent, or Firm*—William H. Maxwell

[57] ABSTRACT

A quickly replaceable padding for athletic gear and the like, comprised of a depressible core coextensively bonded within an envelope of impervious sanitary material and to which at least one strap is anchored by sewing to a doubler coextensively bonded between the core and envelope, the padding being attached by primary securement to an overlying structural member by turning of the strap over a bitt formed on the structural member and thereby establishing a bite that holds the pad in position, and in each instance held secure by secondary securement of the strap by hook-and-loop fastener elements pulling in the plane of interface engagement between overlapped secondary fastener elements.

22 Claims, 9 Drawing Figures

(120° BITE)

(180° BITE)

(LOOP)

(HOOK)

REPLACEABLE SHOULDER PADDING FOR FOOTBALL AND THE LIKE

BACKGROUND

This invention relates to the sport of football wherein the players wear protective gear comprised of structural members lined with padding. Included in such gear are knee pads, elbow pads and shoulder pads which are the principal subject of this invention. Heretofore, the padding which lines these protective gear has been sewed into place, by heavy stitching passed through the structural members of sheet material shaped to contours overlying the body parts of the athletes to be protected. In practice, the overlying structural members were fiber material in the past, and at the present day they are formed of high density polyethelene plastic, or the like. By sewing the padding into a secure position at the interior or said structural members, a permanent installation is obtained, but totally secure and immoveable so that replacement is next to impossible on a practical basis. In practice, replacement of sewed together pad construction is resorted to only at wide intervals of time, if at all, because of the very high cost of replacement. For example, the sewing must be cut and pulled out piece by piece, and invariably the padding or lining is destroyed and must be renewed, as it becomes irreparable. Accordingly, it is a general object of this invention to provide easily replaceable padding in athletic protective gear. As shown herein, the protective gear is a shoulder pad for football, not to preclude any other kind of similar protective gear with padding or lining.

Football shoulder pads are bilaterally symmetrical and are comprised of right and left arches extending over the shoulders and with anterior and posterior portions overlying the chest and back of the athlete. The posterior portions are permanently hinged together on a vertical axis over the athlete's back or spine, while the anterior portions are connected together on a vertical line over the athlete's sternum as by means of straps or lacing. Alternately, both anterior and posterior portions are permanently hinged together. At least one epaulet and/or shoulder cap extends laterally from each arch, and these too are lined with padding. In each instance the protecting structural member is lined with padding and they are capable of substantial articulation, forming covers in the nature of mail plates with overlapped portions. It is the padding or inner lining of these various structural members with which this invention is concerned, it being an object to provide for the immediate replaceability of such padding, without the tediousness of cutting out and re-sewing as it has been done throughout the past. In practicing this invention, the padding is made secure without stitching, and without the use of buckles, ties or snaps, yet with security subject to instant replaceability.

The hook-and-loop fastener concept is employed herein as a secondary fastener wherein hard hook elements at one side of an interface of overlapped strapping engages soft loop elements at the other side of the interface. It is characteristic that such a fastener has moderate holding ability or power in the longitudinal plane of the interface, but very little resistance to separation in a direction vertical to that plane. It is significant that tremendous abuse tending to cause separation of any fastener system is continuously existant in athletic gear such as a shoulder pad which is the primary concern herein. That is, the various structural members, hinges, ties and paddings or linings are repeatedly subject to ripping and tearing forces, applied in a multitude of indescribable ways and under high impact loads in combinations of tension and compression applications, resulting in twisting and prying action by said members and underlying padding. The aforesaid hook-and-loop fastener is most satisfactory under passive or static conditions, but it can hardly be said that such an ideal condition exists at all under working conditions associated with the use of football shoulder pads, and the like. Accordingly, it is an object of this invention to provide a fastener system for gear of the type herein referred to which is efficient and totally effective under agressive conditions, as distinguished from a fastener system which alone is satisfactory only under passive conditions. With the present invention, the hook-and-loop fasteners are secondary and do not pull apart as might be expected if applied in the usual manner.

It is an object of this invention to provide for securement of padding to the flat and contoured undersurface of structural members, by means of a strap having a "bite" engagement over a "bitt" provided in an overlying structural member. As will be described, primary securement is established by means of a single bite over a single bitt, and preferably securement is established by means of a double bite over a pair of spaced bitts. The strap or straps are then made secure by secondary hook-and-loop fastener means, all as hereinafter described.

SUMMARY OF THE INVENTION

Athletic gear of the type under consideration is not only subject to abuse that requires replacement and repair, but it is subject to soiling and the development of unsanitary conditions. Not only is there soiling by dirt and mud, but also by the normal sweat that is excreted by the body functions of the athlete working with extreme physical effort. Heretofore, such athletic gear has been stored in soiled sweat laden condition and any cleaning thereof has been purely superficial, since the padding has not been removeable from the structural members supporting the same. Therefore, state of the art athletic gear is not conducive to good hygiene, and the oderous gear maintained in dirty condition for weeks and months on end is in reality deleterious to health, and all of which is a prime consideration in athletics.

Therefore, it is an object of this invention to provide easily replaceable padding in athletic gear, padding that can be immediately removed and reapplied, through simple manipulation of primary securement and secondary fastener means, a primary securement comprised of a "bite" over a "bitt" for holding power, and a secondary securement means comprised of hook-and-loop fastener employed in its usual passive and/or static condition.

A feature of this invention is the impervious encapsulated nature of the padding per se, each padding being a replaceable component of closed cell plastic in an envelope of impervious plastic impregnated fabric, and all of which is conducive to durability and to sanitary conditioning, especially in that the padding is removeable with facility for regular cleaning, replacement and repair.

DRAWINGS

The various objects and features of this invention will be fully understood from the following detailed description of the typical preferred form and application thereof, throughout which description reference is made to the accompanying drawings.

Figure 8:
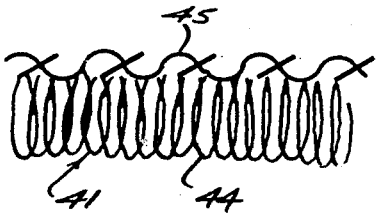
Figure 9:
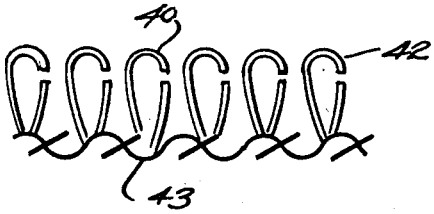

And, FIGS. 8 and 9 are enlarged detailed fragmentary views of the hook-and-loop secondary securement means as it is employed herein.

PREFERRED EMBODIMENT

Referring now to the drawings, a shoulder pad is shown as it is comprised of protective structural members and underlying padding. The principal structural member is the body arch A that extends over the shoulder, there being right and left arches A and each with a depending anterior portion overlying the chest and with a depending posterior portion overlying the back. In addition there is a cup-shaped shoulder cap C or epaulet that overlies the deltoid muscle of the shoulder, and there is a shoulder flap F that overlaps the hinge space between arc A and cap C and which is characterized by a depending anterior portion that overlies the armpit area and the infra-spinatus, terres minor and terres major muscles. The cap C and flap F are hinged to the connecting portion of the arch A by flexible straps 11 and 12 of substantial width secured by rivets 13, all in the usual manner. Accordingly, the structural members are free to articulate so as to accomodate body movements of the athlete. As shown, the complete shoulder pad is bilaterally symmetrical with right and left body arches A that are permanently joined by wide flexible straps 14 connecting the posterior portions of the arches, said straps 14 overlying the spinal area between the scapulas. The anterior portions of the arches A are releasably connected by lacing 15 tied and adjusted thereby to the girth of the athlete. These structural members A, C and F as thus far described are state of the art and made of the usual materials, with fasteners and reinforcements employed therein as circumstances require.

The padding configurations as they are disclosed herein are also state of the art, but improved with respect to replaceability and with respect to sanitation. Each body arch A, right and left, is interfaced with and carries an underlying arch pad P1, each shoulder cap C is interfaced with and carries an underlying cap pad P2, and there is an additional deltoid pad P3 disposed between the pads P1 and P2, over the deltoid and arm pit areas. Each of these pads is fashioned according to the physical requirements of the athlete to be protected thereby, and each pad is adapted to be removeable in accordance with this invention. However, in order to simplify the drawings and following detailed description of a primary securement means S1 and a secondary securement S2 for releasibly anchoring such pads, only the pad P1 will be described as shown releasably anchored thereby.

The pads P1, P2 and P3 are comprised of open cell foamed plastic contained within a contiguous envelope 17 of impervious fabric. A preferred open cell foamed plastic is a low density polyfoam and a preferred impervious fabric is plastic impregnated Nylon. The interface between the exterior surface of layer 16 and the inside of envelope 17 is coextensively contiguous by adhesion or bonding of the two materials together at the interface therebetween. Characteristically, there is no stitching through the pad, the inner and outer faces 18 and 19 of the envelope being joined by stitched binding 20 at the periphery of the pad. In practice, there is a neck roll 20' sewed to the binding 20 at a convexly curved inner edge of the pad P1, to form the neck opening of the assembled shoulder pad. Thus, either face 18 and 19 can be free of any encumberances that would cause discomfort to the wearer. For example, there can be no separation of the envelope 17 from the depressible layer 16, and accordingly no protruding wrinkles can develope such as to cause chaffing against the athlete's body.

Figure 1:
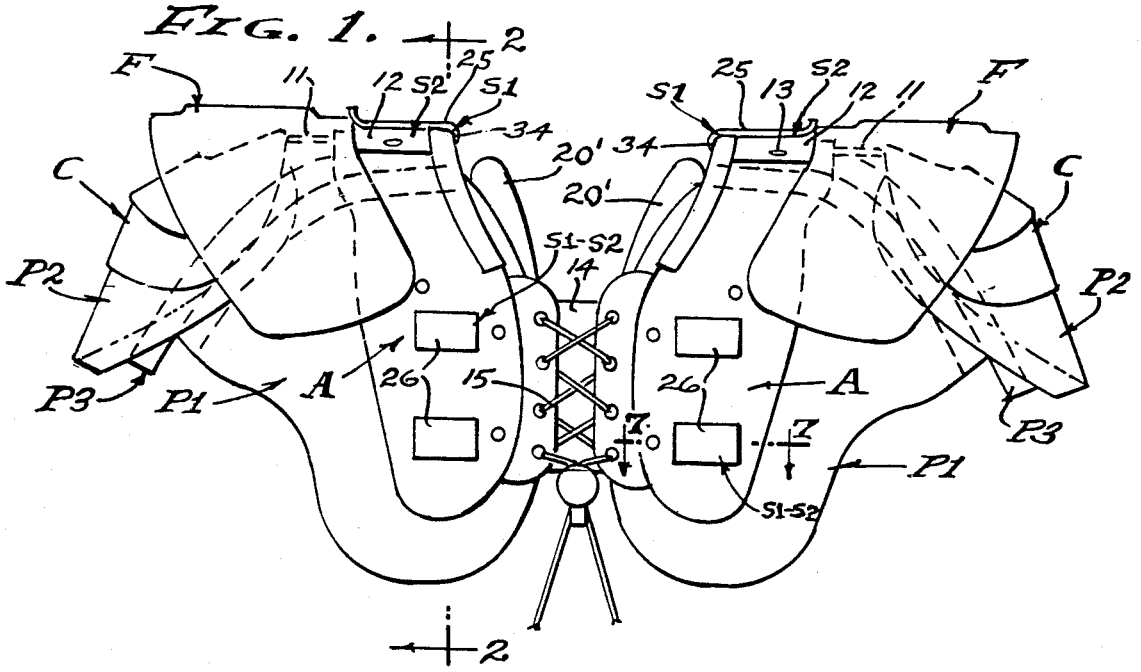
FIG. 1 is a front elevation view illustrating a typical shoulder pad for football and incorporating therein the replaceable shoulder padding of the present invention.
Figure 2:
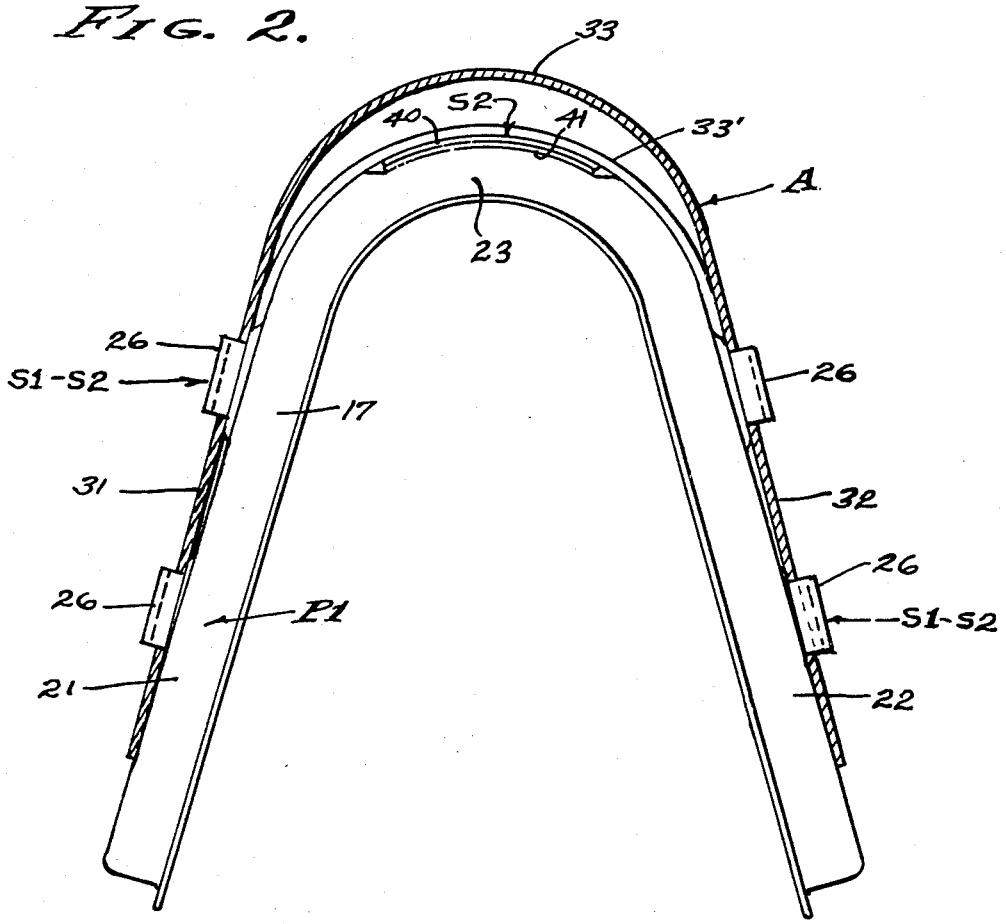
FIG. 2 is an enlarged sectional view taken substantially as indicated by line 2—2 on FIG. 1.
Figure 3:
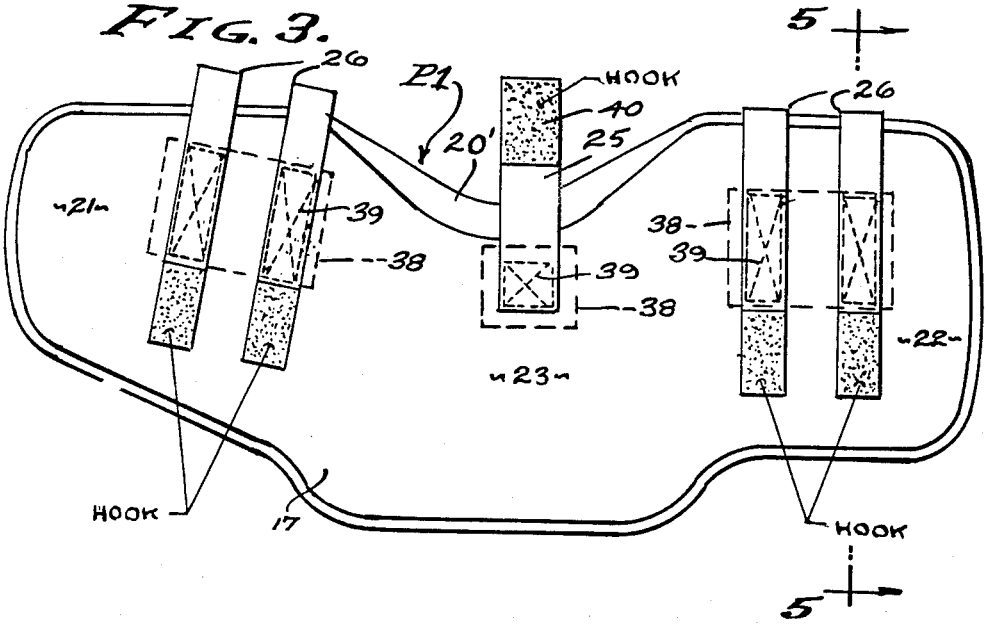
FIG. 3 is a flattened plan view of one of the arch paddings removed from the left hand structural member shown in FIG. 1, showing the interface side thereof that is fitted to the inner contours of the arch member.
Figure 4:
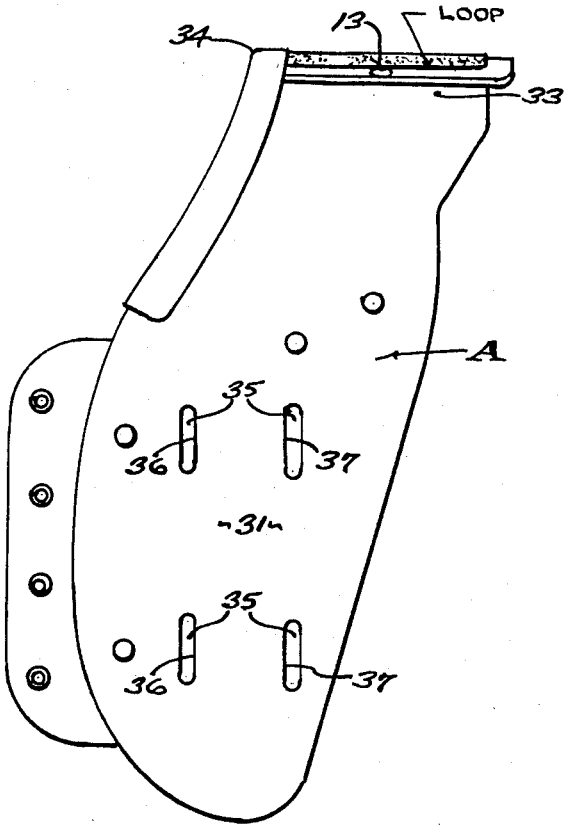
FIG. 4 is an enlarged front view of the left hand arch member removed from the other members and padding shown in FIG. 1.
Figure 5:
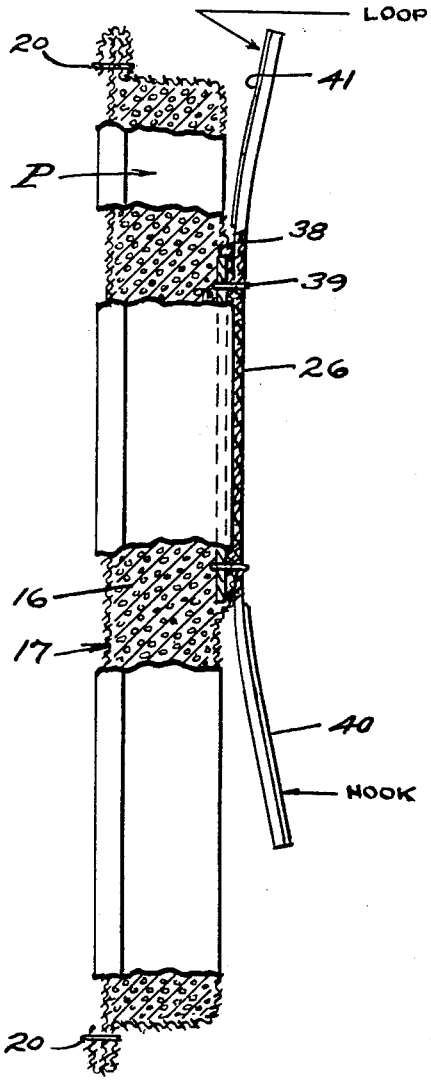
FIG. 5 is an enlarged detailed view taken substantially as indicated by line 5—5 on FIG. 3, and with portions thereof in section.

Referring to FIG. 3 of the drawings, the left arch pad P1 is shown in its typical configuration having an anterior portion 21, a posterior portion 22, and a connecting shoulder portion 23. The inner face of pad P1 is shown with straps 25 and 26 installed in accordance with this invention. Referring to FIG. 4 of the drawings, the left body arch A is shown separately in its typical configuration, in front view showing its anterior portion. The outer face of the arch A is shown with elongated slot-shaped bitt openings (35) for the reception of the straps 26, in order to establish a "bite" as the primary securement means S1. Referring to FIG. 2, the arch pad P1 when installed underlies the body arch A, so that its anterior portion 21 has interface engagement with the inside of the anterior portion of the arch, and so that its posterior portion 22 has interface engagement with the inside of the posterior portion of the arch. Note that the connecting shoulder portion of the pad P1 has some clearance from the overlying complementary portion of the body arch A, where it bears upwardly against an inner arch strap 33' (see FIGS. 2 and 6) for securement as will be described. It is the spaced and interface relationships of the pad and arch that are secured and thereby anchored by the present invention.

In accordance with this invention, the body arch A has an anterior portion 31 complementary to portion 21 of the pad P1, a posterior portion 32 complementary to portion 22 of the pad P1, and a connecting shoulder portion 33 complementary to the portion 23 of the pad P1. The neck opening of the assembled shoulder pad is established by a convexly curved inner edge of the shoulder portions 23 that are each covered by a heavy binding and each forming a corner establishing a bitt 34 of the primary securement means S1, for attachment of the connecting portions 23 and 33. The anterior and posterior portions 31 and 32 are alike and each has at least one pair of slot-shaped bitt openings 35 forming apposed straight edged corners that establish juxtaposed bitts 36 and 37 of the primary securement means S1, for attachment of the anterior and/or posterior portions 31 and 21 and/or 32 and 22. In practice, there are upper and lower pairs of bitt openings 35 for the reception of upper and lower straps 26.

In accordance with this invention, the straps 25 and 26 are anchored to the pad P1 by a lamination thereto of high density foamed plastic in the form of a relatively thin doubler 38 to which the straps are sewed by stitching 39, prior to assembly with the foamed plastic layer 16. The doubler 38 of higher density foamed plastic such as a high density polyfoam is contiguously adhered or bonded to both the exterior of layer 16 and to the interior of the envelope 17, with margins around the strap stitching 39. Accordingly, the straps 25 and 26 are securely anchored to a substantial area of the padding P1.

In accordance with this invention, each of the flat straps 25 and 26 extends from the anchor so as to be turned around a straight edged bitt in order to establish the primary securement means S1 in the form of a "bite", which is defined as a "hold or grip by which friction is created or purchase is obtained" (Webster). "Bite" is also defined as "a surface that creates friction or is brought into contact with another for the purpose of obtaining a hold; make fast about a bitt; a single or double post for securing lines" (Webster). A "bitt" over which a bite is made is defined as a "a part—to which cables, etc., are made fast; usually in pairs, to take a turn of (a cable) around a bitt or a pair of bitts" (Funk & Wagnalls). In this invention straps 25 or 26 turned over bitts 34, or 36 and 37 and thereby establish bites as a primary securement. In practice, the straps 25 and 26 are disposed so as to be warped or turned over the bitts 34 or 36 ad 37 substantially more than 90°, at least 120°, and preferably 180°. It is in this manner that primary bite is established and holding power is attained.

Figure 6:
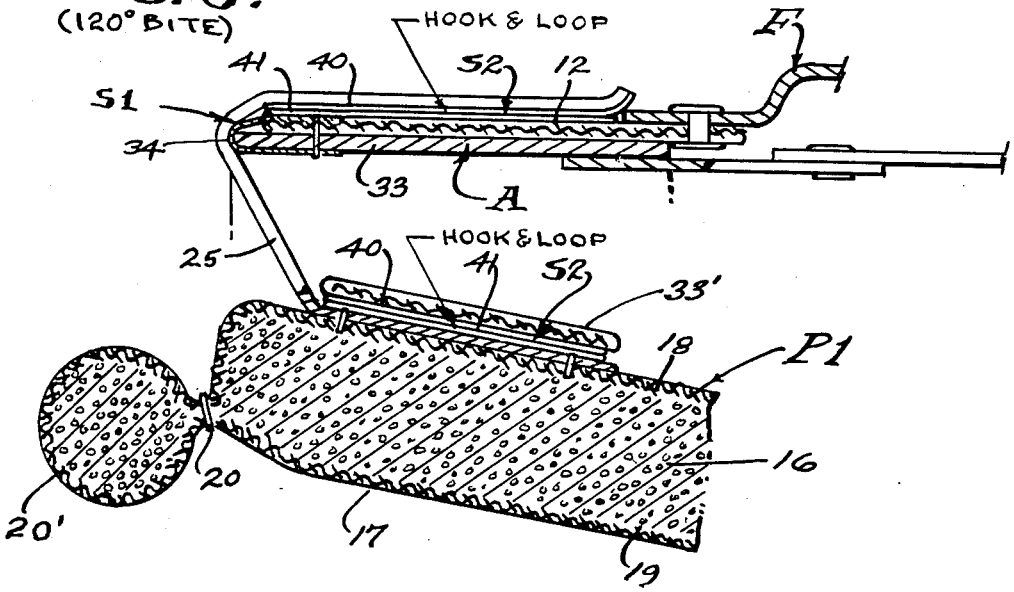
FIG. 6 is an enlarged detailed fragmentary sectional view showing the singular primary and secondary securement of the padding to the arch.

In FIG. 6 of the drawings, the single strap 25 is anchored to the shoulder portion 33 so as to extend outwardly and be turned upwardly and inwardly and approximately 120° over the edge or bitt 34, in order to establish the primary securement means S1. The otherwise loose end of the strap 25 then contiguously overlies the shoulder portion 33 where it is fastened by the hook-and-loop secondary securement means S2, as later described.

In FIGS. 2 and 6 of the drawings, upward positioning of the pad P1 is restricted by the inner strap 33', where pad P1 is secured in position against the inner strap by hook-and-loop secondary securement means S2, as later described. This securement prevents lateral shifting in the arch area of pad P1.

Figure 7:
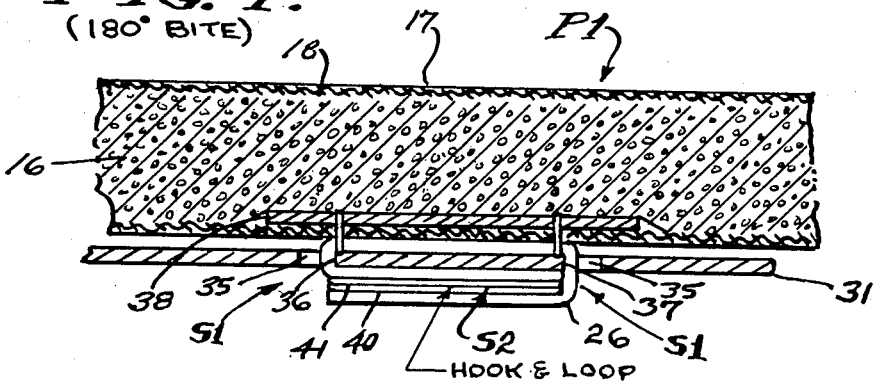
FIG. 7 is an enlarged fragmentary sectional view showing the double primary and secondary securement of the padding to the arch and taken as indicated by line 7—7 on FIG. 1.

In FIG. 7 of the drawings, double strap 26 is anchored to the posterior portion 32, or as shown to anterior portion 31, so as to extend laterally in opposite directions and turned through openings 35 and back over the edges of the juxtaposed bitts 36 and 37 respectively, in order to establish double primary securement means S1. The otherwise loose end of the strap 26 then contiguously overlap each other where they are fastened together by the hook-and-loop secondary fastener means S2, as next described.

As best illustrated in FIGS. 6 and 7 of the drawings, the otherwise loose ends of the straps 25 and 26 which are held secure by the holding bite of the primary securement means S1 are then fastened by the secondary securement means S2 in the form of a hook-and-loop fastener. In practice, the hard hook element of the secondary securement means S2 faces inwardly, while the soft loop element thereof faces outwardly, the means S2 being comprised of a hook element 40 and a loop element 41. The hook element 40 and loop element 41 as shown in FIGS. 8 and 9 are "VELCRO" as manufactured by Velcro USA INC. of 618 Fifth Avenue, New York, N.Y., 10022, or "Scotchmate" as manufactured by 3M Company, St. Paul, MN. 55101, or the like. The hook element 40 (see FIG. 9) of the fastener means S2 is comprised of a closely arranged multiplicity of minute hooks 42 extending coextensively over and uniformly a short distance from a backing tape 43. The loop element 41 (see FIG. 8) of the fastener means S2 is comprised of a loop pile of minute fibers 44 of uniform weight, thickness and density, coextensively overlying a backing tape 45. In carrying out this invention, the desired orientation of the flat sided elements 40 and 41 is determined and the hook-and-loop elements pressed into contiguous engagement one with the other for a press fit securement having its greatest strength in lateral shear.

From the foregoing it will be seen that the protective padding of the present invention is replaceable with facility to the structural members of athletic gear, shown herein as applied to shoulder pads for playing football. The pads are sanitary, as they are easily cleaned, and they are comprised of a depressible core or layer within a supple envelope of impervious material or fabric. A feature is the coextensive adhesion or bonding of the envelope to the core layer, and also the reinforced anchorage of the straps that are sewed to doublers coextensively adhered or bonded between the envelope and core layer. Quick and reliable attachment of the padding in working position is by primary securement means comprised of the turning of the strap over a bitt and thereby establishing a bite that holds the pad in position at those places shown and hereinabove described. In each instance the strap is then secured by overlapped engagement of hook-and-loop fastener elements pulling in the plane of interface engagement. In use and under normal abuse and strain, this primary and secondary system of securement has proven to be effective and reliable, when covered only by the usual light weight shirt or jersey that is worn thereover.

Having described only a typical preferred form and application of my invention, I do not wish to be limited or restricted to the specific details herein set forth, but wish to reserve to myself any modifications or variations that may appear to those skilled in the art as set forth within the limits of the following claims.

I claim:

1. Athletic gear and the like with quickly replaceable padding, and including in combination;

a protective structural member formed to overlie a part to be protected and having an edge positioned and shaped to form a bitt, a protective pad of depressible material formed to be disposed between the interior of the structural member and the part to be protected and engageable therewith, at least one flexible strap anchored to the pad and having a free end portion turned tightly over the bitt to form a bite and establish a primary securement means to hold the pad, and the free end portion of the strap having hook-and-loop fastener means releasably holding said portion contiguous to the exterior of the structural member and thereby establishing the securement of a secondary securement means.

2. Athletic gear and the like with padding as set forth in claim 1, wherein the hook-and-loop fastener means is comprised of a multiplicity of hooks exposed at one side of a first tape and a pile of looped fibers exposed at one side of a second tape, said tapes being secured to opposed faces of the strap and exterior of the structural member and releasably engageable one with the other.

3. Athletic gear and the like with padding as set forth in claim 1, wherein the free end portion of the flexible strap is turned at least 120° over the bitt for primary securement.

4. Athletic gear and the like with padding as set forth in claim 1, wherein the free end portion of the flexible strap is turned 180° over the bitt for primary securement.

5. Athletic gear and the like with padding as set forth in claim 1, wherein the depressible material of the protective pad is coextensively contiguous to the interior of an envelope and to which said at least one flexible strap is anchored.

6. Athletic gear and the like with padding as set forth in claim 5, wherein the depressible material of the protective pad is foamed plastic, and wherein the envelope bonded thereto is an impervious plastic impregnated fabric.

7. Athletic gear and the like with padding as set forth in claim 1, wherein the depressible material of the protective pad is coextensively contiguous to and bonded to the interior of an envelope to which said at least one flexible strap is anchored.

8. Athletic gear and the like with padding as set forth in claim 7, wherein the depressible material of the protective pad is a substantially thick body of foamed plastic of low density, wherein the doubler is a relatively thin body of higher density plastic, and wherein the envelope bonded thereto is an impervious plastic impregnated fabric.

9. Athletic gear and the like with padding as set forth in claim 1, wherein the depressible material of the protective pad is coextensively contiguous to the interior of an envelope with a doubler disposed therebetween and all of which is bonded and to which said at least one flexible strap is anchored.

10. Athletic gear and the like with padding as set forth in claim 9, wherein the depressible material of the protective pad is a substantially thick body of foamed plastic of low density, wherein the doubler is a relatively thin body of higher density plastic, and wherein the envelope bonded thereto is an impervious plastic impregnated fabric.

11. Athletic gear and the like with padding as set forth in claim 1, wherein the depressible material of the protective pad is coextensively contiguous to the interior of an envelope with a doubler disposed therebetween and all of which is bonded and to which said at least one flexible strap is anchored by sewing through the envelope and doubler.

12. Athletic gear and the like with quickly replaceable padding, and including in combination;

a protective structural member formed to overlie a part to be protected and having apposed openings therethrough and juxtaposed to form a pair of spaced bitts, a protective pad of depressible material formed to be disposed between the interior of the structural member and a part to be protected and engageable therewith, at least one flexible strap anchored to the pad and having opposite free end portions and each turned tightly over one of said bitts to form a pair of apposed bites and each establishing a primary securement means to hold the pad, and the opposite free end portions of the strap having hook-and-loop elements of fastener means releasably holding said free end portions of the strap contiguous to the exterior of the structural member between said openings and establishing a secondary securement means.

13. Athletic gear and the like with padding as set forth in claim 12, wherein the hook-and-loop fastener means is comprised of a multiplicity of hooks exposed at one side of a first tape and a pile of looped fibers at one side of a second tape, said tapes being secured to opposite end portions and opposite faces of the strap for overlapped releasable engagement one with the other.

14. Athletic gear and the like with padding as set forth in claim 12, wherein the free end portion of the flexible strap is turned at least 120° over the bitt for primary securement.

15. Athletic gear and the like with padding as set forth in claim 12, wherein the free end portion of the flexible strap is turned 180° over the bitt for primary securement.

16. Athletic gear and the like with padding as set forth in claim 12, wherein the depressible material of the protective pad is coextensively contiguous to the interior of an envelope and to which said at least one flexible strap is anchored.

17. Athletic gear and the like with padding as set forth in claim 12, wherein the depressible material of the protective pad is coextensively contiguous to and bonded to the interior of an envelope to which said at least one flexible strap is anchored.

18. Athletic gear and the like with padding as set forth in claim 17, wherein the depressible material of the protective pad is foamed plastic, and wherein the envelope bonded thereto is an impervious plastic impregnated fabric.

19. Athletic gear and the like with padding as set forth in claim 12, wherein the depressible material of the protective pad is coextensively contiguous to the interior of an envelope with a doubler disposed therebetween and all of which is bonded and to which said at least one flexible strap is anchored.

20. Athletic gear and the like with padding as set forth in claim 19, wherein the depressible material of the protective pad is a substantially thick body of foamed plastic of low density, wherein the doubler is a relatively thin body of higher density plastic, and wherein the envelope bonded thereto is an impervious plastic impregnated fabric.

21. Athletic gear and the like with padding as set forth in claim 12, wherein the depressible material of the protective pad is coextensively contiguous to the interior of an envelope with a doubler disposed therebetween and all of which is bonded and to which said at least one flexible strap is anchored by sewing through the envelope and doubler.

22. Athletic gear and the like with padding as set forth in claim 21, wherein the depressible material of the protective pad is a substantially thick body of foamed plastic of low density, wherein the doubler is a relatively thin body of higher density plastic, and wherein the envelope bonded thereto is an impervious plastic impregnated fabric.

* * * * *